US010418155B2

(12) United States Patent
Keil et al.

(10) Patent No.: US 10,418,155 B2
(45) Date of Patent: Sep. 17, 2019

(54) TWISTING DEVICE FOR ELECTRICAL CONDUCTORS

(71) Applicant: Schleuniger Holding AG, Thun (CH)

(72) Inventors: Uwe Keil, Hückeswagen (DE); Roland Kampmann, Witten (DE)

(73) Assignee: SCHLEUNIGER HOLDING AG, Thun (CH)

( * ) Notice: Subject to any disclaimer, the term of this patent is extended or adjusted under 35 U.S.C. 154(b) by 203 days.

(21) Appl. No.: 15/334,698

(22) Filed: Oct. 26, 2016

(65) Prior Publication Data

US 2017/0125139 A1 May 4, 2017

(30) Foreign Application Priority Data

Oct. 28, 2015 (EP) ..... 15191926

(51) Int. Cl.
*H01B 13/02* (2006.01)

(52) U.S. Cl.
CPC ..... *H01B 13/0278* (2013.01); *H01B 13/0207* (2013.01)

(58) Field of Classification Search
CPC ..... H01B 13/02; H01B 13/0214; H01B 13/0221; H01B 13/0228; H01B 13/0278; H01B 13/0207
See application file for complete search history.

(56) References Cited

U.S. PATENT DOCUMENTS 4,272,951 A * 6/1981 Vogelsberg ..... H01B 13/0235 57/293
6,167,919 B1 1/2001 Fuchsl
6,289,944 B1 * 9/2001 Frommenwiler .. H01B 13/0207 140/149
9,416,488 B2 * 8/2016 Stier ..... D07B 3/04
2014/0331636 A1 * 11/2014 Keil ..... D01H 7/04 57/73
2015/0101700 A1 4/2015 Stier

FOREIGN PATENT DOCUMENTS

DE 19631770 A1 2/1998
WO 2013068990 A1 * 5/2013

OTHER PUBLICATIONS

European Search Report for corresponding EP Application No. 15191926.3-1801, 5 pages, dated Mar. 17, 2016.

* cited by examiner

*Primary Examiner* — Carl J Arbes
(74) *Attorney, Agent, or Firm* — Matthew B. Dernier, Esq.

(57) ABSTRACT

Twisting device for electrical conductors has at least one twisting head that rotates about an axis of rotation and a clamping device. The twisting head is movable in the direction of its axis of rotation toward the clamping device and is mounted on a first, motorized length compensation carriage, while the clamping device is mounted on a travel compensation carriage that is movable towards the length compensation carriage parallel to the axis of rotation of the twisting head. After the conductors have been cut to size and transferred to the twisting head and the clamping device, they are placed under tension. Then, the twisting head is activated to rotate about an axis of rotation parallel to the conductors while simultaneously moving towards the clamping device. Simultaneously, the clamping device is subjected to a force directed away from the twisting head and the travel/force profile for the clamping device is evaluated.

12 Claims, 2 Drawing Sheets

TWISTING DEVICE FOR ELECTRICAL CONDUCTORS

CROSS REFERENCE TO RELATED APPLICATIONS

This application claims the priority to European Application No. EP15191926.3, filed on 28 Oct. 2015, which is hereby incorporated in its entirety by reference.

BACKGROUND

The invention relates to a twisting device for electrical conductors a method therefore according to the disclosed embodiments.

A method for twisting electrical or optical conductors such as wires, cables, cable bundles, waveguides, etc., in a twisting device with two counter-rotatable twisting heads is disclosed in WO2013068990A1. The conductors are drawn into the twisting device between the twisting heads one after the other and the distance between the twisting heads is reduced as the twisting process progresses, preferably as a function of the number of revolutions of the twisting heads, in order to compensate for the overall shortening of the twisted conductors as the twisting continues. Advantageous variants provide for gradually increasing the rotating speed of the twisting heads in a first phase of the twisting process and then gradually reducing the speed in a second phase of the twisting process, or also increasing and reducing the rotating speeds of the twisting heads separately, or twisting them according to programmable speed profiles.

Significant problems associated with such methods include the lengthwise variability of the individual conductors, tolerances due to conductor transfers in the machine, temperature fluctuations and tolerances in the external diameter of the conductor. The quality of the twisting also depends on the force that is applied when twisting in the conductor axis. It is extremely difficult to apply a constant force to the conductors corresponding to the shortening profile when twisting in an automated process. Such an arithmetical (theoretical) determination of the shortening profile must be adapted individually for each twist in order to preclude the disturbance variables.

This also applies for a device such as the one disclosed in EP1032095B1, in which the intention is to regulation the shortening profile. The conductor is clamped in place on both sides, a force sensor on a fixed gripper is applied. A twist rotor is fitted movably and travels over the shortening of the conductor, synchronised as closely as possible with the actual shortening of the conductor, wherein its position is regulated taking into account the measured force. The tensile force is calculated at the fixed-position conductor terminal, and the advance path of the twisting motor is regulated from this. This solution requires very fast signal processing. Even so, the force fluctuates by a predetermined value in the control process, and the reaction must be delayed because the process is extremely dynamic, so it is very difficult to compensate for an error. It is almost impossible to maintain an exact tensile force, and this too can lead to a high reject percentage. This applies particularly for short conductors for twisting, since they have scarcely any axial damping effect; an extremely large amount of effort must be applied for control.

Another group of machines, the "semi-automated conductor twisters", work in the area of the conductor shortening against a permanent force, which is typically applied pneumatically. Quality monitoring would only be possible with the investment of considerable sums of money due to the long shortening paths. This issue is not particularly important for manual processing, because the operator sees each conductor in production and so is able to detect faults quite effectively Similar problems to those stated above also arise in stranding. Thus for example DE19631770A1 discloses a stranding machine in which prepared conductors are clamped by hand. The two conductors are stranded by rotating both conductors starting at the conductor ends secured in the twisting head and at the same time with a controlled twisting shuttle process, so that the distance between the twisting shuttle and the twisting head becomes larger as the process continues. In this process, it is the conductor sections located between the twisting shuttle and the twisting head that are twisted. Document DE19631770A1 also describes how the twisting clamp mountings are arranged so as to be displaceable along the linear guides by means of a forward motion device, e.g., a pneumatic cylinder with counter-pressure control. This forward motion device with pneumatic cylinder and counter-pressure control, mounted under the twisting head with the twisting clamp mountings travels along the entire shortening path that is created by twisting.

SUMMARY

It was therefore the object of the present invention to create a twisting device of such kind as would enable easy monitoring of the twisting process, which is highly dynamic and also very difficult to regulate due to interference factors such as material tolerances, enable process automation while retaining the tensile strength unchanged as far as possible, wherein load peaks at the conductors may be avoided, and providing the capability of direct quality control of the twisted conductors. A further object of the invention was a method for manufacturing twisted conductors having the advantages described.

The object is solved with the features presented in the figures and the specification, and claims.

The starting point is a device having at least one twisting head that is drivable by motor power to rotate about an axis of rotation relative to a base, and a clamping device for the ends of the conductor farthest from the twisting head, wherein the twisting head is movable in the direction of its axis of rotation toward the clamping device. The clamping device may be for example a fixed position, that is to say non-rotary conductor clamp. The motorised mobility of the twisting head may be realised with any form of motive power such as electric motors, pneumatic- or hydraulic-based fluid motors etc.

In order to solve the problem as stated, a device of such kind is characterised in that the twisting head is mounted on a first, automatically and motorised movable length compensation carriage, wherein the clamping device is mounted on a travel compensation carriage that is movable towards the length compensation carriage in a direction essentially parallel to the axis of rotation of the twisting head, and to which a force acting essentially parallel to the axis of rotation may be applied via a force generating element.

In this context, it is preferably provided that a further twisting head which is rotatable in the opposite direction with regard to the first twisting head about an axis of rotation shared with the first twisting head is mounted as a clamping device on the travel compensation carriage.

According to a preferred embodiment of the invention, the travel compensation carriage is passively displaceable and is subjected to a force directed away from the first twisting head by means of a preload element. In this way, a tensile force is applied to the conductors over the entire displacement range of the elements that are moved during the twisting process, thereby improving the twisting process and the quality thereof.

In such a case, the preload force of the preload element is adjustable at least before the start of activation of the drive unit of the length compensation carriage and preferably remains constant throughout the twisting process. In this way, a constant tensile force can be applied over the entire displacement range during twisting. Consequently, compensation is made for material-related tolerances during twisting as the axially movable clamping device adapts its axial holding position according to the constant tensile force.

According to an advantageous embodiment, a simple and readily adjustable construction of the preload element is realised with a fluid cylinder, preferably a pneumatic cylinder, connected to a pressure source via a controlled pressure control valve.

A further optional feature according to the present invention consists in that the piston rod of the fluid cylinder and/or the travel compensation carriage, respectively, is equipped or coupled with a displacement sensor, which is connected to an evaluation unit for calculating and evaluating the travel profile of the travel compensation carriage. For example, it is possible to monitor the position of the piston rod and the carriage, which corresponds to the holding position of the clamping device. Since the axial movements of the clamping device during the twisting process are quite small, typically in the order of 40 mm, the twisting process can easily be monitored within the "normal" tolerances. Faults and errors outside of this normal twist process lead to a departure from the monitoring tolerance margin. Accordingly, it is possible to implement quality control of the twisting process. Instead of the displacement sensor, initiators are also conceivable and are damped as long as the carriage is displaced within the permissible monitoring tolerance range.

Instead of a preload element, which is exposed to a constant preload force to compensate for different axial paths during the twisting process, according to a further embodiment of the invention the force compensation carriage may be equipped with a force measuring sensor and a motorised drive unit as the force-generating element. In this case, the travel compensation carriage is subjected to a force directed away from the first twisting head depending on the signals of the force measuring sensor. Said if need be variable force is applied by the drive unit at least during the twisting process.

In this case the travel profile of the clamping device—albeit now actively definable—can also be included for quality control of the twisting process. For this purpose, according to the invention the drive unit or a control device for the force compensation carriage is connected to an evaluation unit for calculating and evaluating the travel profile of the force compensation carriage.

According to a further embodiment of the invention, it is provided that a drive unit for the length compensation carriage is activatable via a programmable controller to travel a travel profile prescribed for each conductor, conductor type and/or twist parameter, primarily towards the clamping device, and wherein the maximum possible displacement path of the travel compensation carriage is kept shorter than the maximum possible displacement path of the length compensation carriage by preferably adjustable limit stops. The twisting process has the effect of shortening the length of the twisted conductor according to a parabolic function corresponding to the number of twisting revolutions executed. Variables in the twisting process are for example the diameter of the conductor, the conductor material, the conductor length, the number of twist revolutions (forwards and then backwards to reduce tension), the tensile force during twisting and the twist pitch length that is to be obtained as the result of twisting. Thus, the shortening of the length in the twisting process can be described mathematically in terms of the aforementioned variables and can be stored as a file (the "formula"). The base data for these formulas is initially calculated in preliminary tests for each conductor cross section. After it has been found, the base data may then serve as the basis for deriving other conductor lengths mathematically. Theoretically, the axial tensile strength in the conductor pair according to the formula would remain substantially constant providing no disturbance factors such as material tolerances prevented this. However, compensation for these tolerances can be assured by a constant holding force on the clamping device with a much smaller axial shift than is necessary for the twisting itself.

In order to be able to automate not only the process but also monitoring of the twisting processes as far as possible, preferably at least the drive unit of the length compensation carriage is connected to a control unit, in which a travel profile for actuating the drive unit of the length compensation carriage for every combination of conductors and twist parameters is stored.

In this context, it is advantageously provided that a routine is implemented in the control unit which queries the evaluation unit and/or the displacement sensor and depending on the calculated travel profile of the travel compensation carriage generates a quality assessment and/or adapts the travel profile of the length compensation carriage, if need be stores it in the control unit as the new travel profile for this combination of conductors and twist parameters, and/or cancels the twisting process with an error message.

Monitoring of the twisting process can also be used to adapt the parameters of the twisting process automatically. The ideal device for this is one which is characterised in that a routine is implemented in the control unit and controls the length compensation carriage in such manner that the values delivered by the displacement sensor fall within a prescribed range, and which generates a quality assessment based on the calculated travel profile of the travel compensation carriage and/or adapts the travel profile of the length compensation carriage, if need be stores it in the control unit as the new travel profile for this combination of conductors and twist parameters, and/or cancels the twisting process with an error message In order to solve the problem stated in the introduction, a method may also be adapted for twisting electrical conductors. The basic steps for such a methods comprise the following:

- cutting a first conductor to size and transferring it to an actively mobile twisting head and an oppositely positioned displaceable clamping device,
- clamping the conductor between the twisting head and the clamping device by moving at least the twisting head away from the clamping device,
- activating the twisting head so that it rotates about an axis of rotation parallel to the clamped conductor while at the same time moving the twisting head towards the clamping device according to prescribed travel profile.

Such a method is characterised according to the invention by the following steps:

applying a force, if need be a different magnitude of force directed away from the twisting head to at least the clamping device, at least during the twisting process, and determining and evaluating a travel or force profile for the movable clamping device.

The steps below are preferably provided as further optional steps:

motorised displacement of the twisting head away from the clamping device after the conductor has been clamped in place and before the actual twisting process begins, until the clamping device has been moved by a predefined travel distance or predefined force is exerted, measuring or at least indirect determination of a characteristic value for the length of the conductor from the position subsequently taken up by the twisting head, repeating the above steps with a second or any further conductor which is to be twisted together with the first conductor, wherein a correction value for cutting the second or any further conductor to length is determined from the measured values or characteristic values.

A further variant of the method according to the invention is characterised in that the twisting head completes a preprogrammed travel profile towards the clamping device for each conductor type and/or twist parameter while the clamping device is shifted towards the twisting head by the force created by the shortening of the twisted conductor against the effect of a force-generating element.

An advantageous preparation of the actual twisting process is possible with a variant of the invention in which the conductors to be twisted are clamped loosely before the start of the actual twisting process, after which the conductors are brought to the required tension after an initial loose twisting by moving the twisting head until the clamping device has been displaced by about half the maximum travel path, wherein the clamping device is subjected to a force away from the twisting head.

Quality monitoring of the twisting process is advantageously possible particularly in the case of an automated process routine when the travel profile of the clamping device is evaluated during the twisting, wherein monitoring preferably covers exceeding a predetermined limit for the travel path and the associated rotation, so that a monitoring range can be represented which if required enables a detailed association of events in which the limit values are exceeded with the rotation.

In one variant according to the invention, it is preferably possible to provide that the travel profile of the twisting head is adapted according to the travel profile of the clamping device, preferably for a definable number of twisting processes with conductors and twist parameters of the same kind.

Further advantages, features and particularities of the invention will be revealed in the following description, in which several exemplary embodiments of the invention are described with reference to the figures of the drawing. The features described in the claims and in the description may all be essential to the invention either individually or in any combination.

DESCRIPTION OF THE DRAWING

The list of reference signs is as much a part of the disclosure as the technical content of the claims and the figures. The figures are described in a logical, interrelated sequence. The same reference signs denote identical components, reference signs with different indices indicate functionally equivalent or similar components.

In the drawing.

DESCRIPTION OF THE EMBODIMENTS

Figure 1:
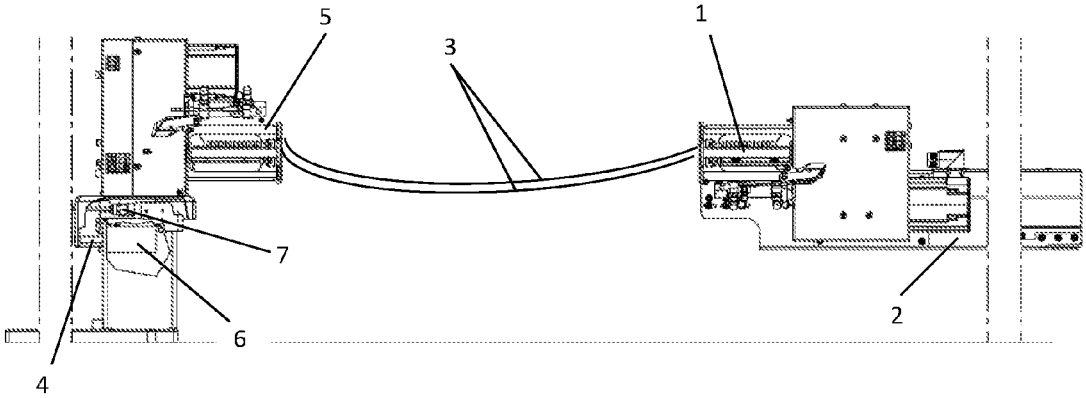
FIG. 1 is a schematic side view of an exemplary twisting device according to the invention with two twisting heads.

The twisting device with compensation for theoretical length shortening during the twisting process represented in FIG. 1 has a twisting head 1. A conductor pair 3 to be twisted is held in place on the side opposite twisting head 1 by a second twisting head 5, wherein the two twisting heads 1, 5 may be rotated in opposite directions about a common axis of rotation. A non-rotating clamping device may also be provided instead of second twisting head 5. As a variant, the non-rotating clamping device may also be provided instead of first twisting head 1, in which case the second twisting head 5 is rotated. In principle, twisting of three or more conductors is also conceivable, if the twisting heads 1, 5 and the clamping device, particularly the clamping mechanisms thereof are designed accordingly.

After conductor pair 3 has been transferred to twisting heads 1, 5, the conductors are initially arranged parallel with each other and the ends thereof are clamped into the grippers of twisting heads 1, 5. As soon as the twisting process is started, the two conductors are wound round each other under the effect of at least twisting head 1, wherein the axial tension should be kept as constant as possible during twisting. However, it may be beneficial to introduce a tensile force that is variable depending on the progress of the twisting process. The twisting process has the effect of shortening the length of twisted conductor 3 between twisting heads 1, 5. Shortening takes place according to a parabolic function depending on the twist revolutions. The number of twist revolutions necessary for the order is approximately equivalent to the length of the twisted conductor 3 (according to the drawing/order) divided by the pitch length. Additionally, about 40% overtwisting must be anticipated, which must then be untwisted.

The length shortening in the twisting process can be described mathematically with the aid of the variables in the twisting process (e.g., conductor diameter, conductor material, conductor length, number of twist rotations (forwards and then backwards to reduce tension), tensile force during twisting and the twist pitch length that is to be obtained as the result of twisting, etc.). The parameters of the twisting process for a specific configuration of these variable may be stored as a file (the "formula"). The base data for these formulas is initially calculated in preliminary tests for each conductor cross section. After it has been found, the base data may then serve as the basis for deriving other conductor lengths mathematically.

The theoretical length shortening is carried out in the twisting process by mounting first twisting head 1 on a length compensation carriage 2, which is movable during twisting according to the required formula actively and preferably on the basis of the twist revolutions via a programmable servo drive unit so as to compensate for the shortening of the conductors 3 to be twisted during the twisting process. Theoretically, the axial tensile force in the conductor pair 3 should remain substantially constant, as is also desirable for most twisting processes. However a variable tensile force profile for twisting might also be programmed on the basis of the suitable formula.

Second twisting head 5—or also the non-rotating clamping device—is mounted on another linear carriage, a travel compensation carriage 4, which can be subjected to a controllable preload force via an adjustable preload element, which force acts in a direction opposite to first twisting head 1 and parallel to the common axis of rotation of twisting heads 1, 5. Carriage 4 is preferably exposed to a constant tensile force, which is particularly unrelated to the carriage position. The tensile force acting during twisting on conductors 3 via twisting head 1 corresponds to the tensile force acting on travel compensation carriage 4.

If due to material tolerances in the process for example the shortening dimension of the twisted conductor does not exactly match the reference path of the length compensation carriage programmed in the travel profile and travelled on twister 1, travel compensation carriage 4 should compensate for this path differential on twisting head 5. The tensile force remains the same.

Figure 4:
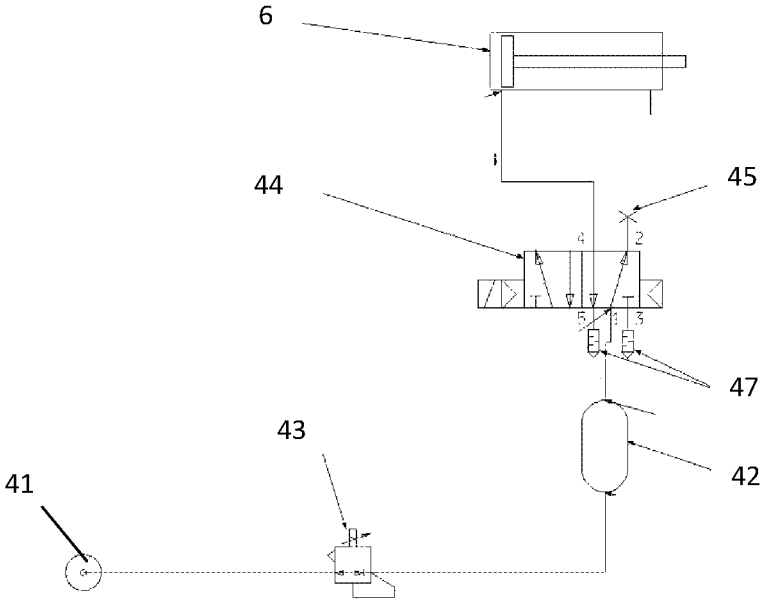
FIG. 4 shows an example of a pneumatic circuit diagram for actuating the preload element for the clamping device.

The preload element may consist of a pneumatic cylinder 6 for example, the working area of which is subjected to a constant pressure that is controllable and unaffected by the piston position. In this way, a defined tensile force may applied to the conductor pair 3 to be twisted in the twisting operation of the entire travel range of length compensation carriage 2 by the equalising effect of travel compensation carriage 4, which is constant for example over the entire travel range of both carriages 2, 4. As is shown in exemplary pneumatic circuit represented in FIG. 4, the pneumatic pressure for supplying cylinder 6 is adjusted from the user interface by means of a programmable pressure regulating valve, preferably a 5/2-way valve 44. The pneumatic system as a whole comprises compressed air source 41, an electro-pneumatic regulator 43 positioned between the compressed air source and the compressed air reservoir 42, as well as two sound dampers 47 on the outlet openings of valve 44. A plug 45 blocks off a parallel path from valve 44 to cylinder 6. Pneumatic cylinder 6 is supplied with pneumatic pressure on one side, so that the tensile force incident on the piston rod is also incident and constant over the entire travel range of the piston. Tolerances due to materials are compensated for during twisting because twisting head 2 which is now axially movable adapts its axial holding position in keeping with the constant tensile force.

Alternatively, it is also possible the vary the pneumatic pressure and therewith also the tensile force acting on conductors 3 as a function of the twist rotations, so that for example a lower tensile force is applied at the start of the twisting process, and is increased progressively. Alternative embodiments are also possible, in which the pneumatic pressure and therewith also the preload force of cylinder 6 is operated according to a programmed profile. This also applies to the subsequent untwisting process.

Figure 2:
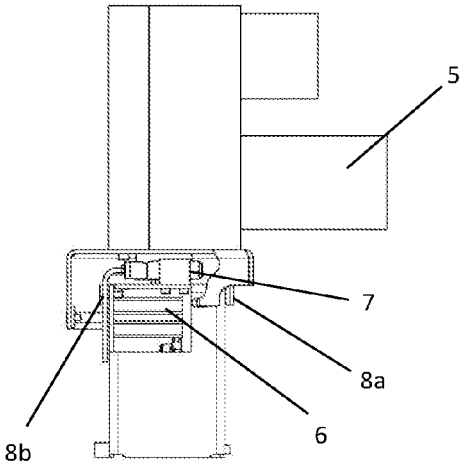
FIG. 2 is an enlarged individual representation of the twisting device assembly of FIG. 1 with the movable clamping device for path compensation in the fully retracted position.
Figure 3:
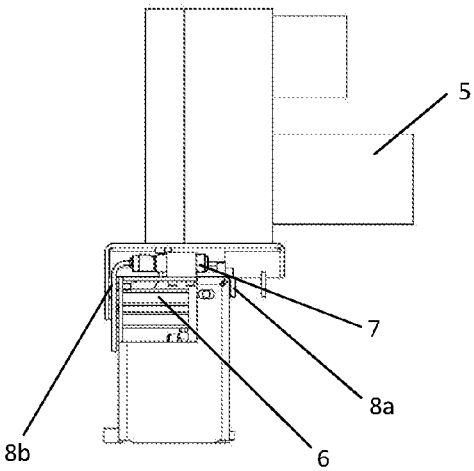
FIG. 3 is an enlarged individual representation of the assembly of FIG. 2 in the fully extended position.

The twist shortening that is to be compensated for by tolerances only requires a relatively short travel path of the travel compensation carriage 4 mounted underneath twisting head 5, particularly compared with the travel path of length compensation carriage 2 for first twisting head 1, typically in the order of about 40 mm. This can also be seen by comparing FIGS. 2 and 3. If the position of the piston rod, the carriage 4 and twisting head 5,—that is to say the twisting head holding position—is monitored by a path sensor 7, it is then possible to monitor the twisting process within "normal tolerances" quite effectively. Faults and errors outside of this normal twist process lead to a departure from the monitoring tolerance margin. This can also be detected, processed and displayed by an evaluation unit. Further actions—cancellation of the twisting process, rejection of the conductor pair as faulty, etc.—may also be triggered thereby, thus enabling a monitoring and quality control function. Advantageously, the maximum possible travel path of travel compensation carriage 4 defined by preferably adjustable limit 8*a*, 8*b* is kept short than the maximum travel path 8 of length compensation carriage 2.

According to the invention, therefore, the twisting process is divided into two movements. After conductor 3 has been clamped loosely in the two twisting heads 1, 5, conductor 3 is placed under tension by the servo powered length compensation either immediately or after a loose initial twist until twisting head 5 or another clamping device positioned opposite twisting head 1 has reached approximately halfway in the possible travel path of the travel compensation carriage.

Pneumatic cylinder 6 then applies an adjusted, constant force to conductor 3. Then, the twisting is started and the length compensation of twisting head 1 progresses according to a prescribed travel profile, wherein twisting head 1 executes an arithmetically calculated equalisation path to reflect the shortening of the conductors 3 that are being twisted.

The second clamping device, in this case the second twisting head 5, travels towards first twisting head 1 on a guide (under certain conditions it may also travel away from twisting head 1), wherein the travel path is determined by the force for clamping conductors 3 during twisting preset at preload element 6. Twisting head 5 and the travel compensation carriage 4 that supports it only compensates for small deviations from the ideal, programmed conductor shortening path.

A displacement sensor 7 or any other transducer in conjunction with second twisting head 5 detects the travel profile thereof during a twist and the deviation of the conductor shortening is calculated in an evaluation unit. For quality monitoring, the travel profile of twisting head 5 for the twisting of conductor 3 is recorded and evaluated. In this way, faulty twisting can be detected throughout the entire operation, and a statistical evaluation is also possible.

It is also possible to optimise the machine process. For this, the travel profile of the length compensation of twisting head 1 is controlled subsequently in steps taking into account the compensation path of twisting head 5 during the first twists for similar conductors 3 and similar twist parameters.

Further advantages of the device and method according to the invention explained for exemplary purposes above:

Capability to monitor twisting with exactly constant tensile force in the automated process.

Testing/monitoring of the finished twisted length

Monitoring of shortening due to twist as quality feature

Very sensitive activation of length correction prevents load peaks in the conductor Improved twisting quality through absolutely consistent tensile force in the automatic twisting process Tensile force profile programmable in the automatic twisting process, with tensile force correlated to the twist rotations as the twisting process progresses and/or during subsequent untwisting Improved detection of incorrect twisting The conductors are not overloaded axially during twisting.

Testing/monitoring of untwisted conductor length

A variant of the invention provides that travel compensation carriage 4 or any similarly operating arrangement enables automatic calculation of the travel profile for the first twisting head 1. The travel profile typically follows a parabolic function. If the actual values for the initial range of the parabola are known, the entire parabola can be calculated from this.

According to the invention, two or even three or more conductors 3 to be twisted are cut to size and clamped between twisting heads 1, 5. For this purpose, the length of the conductors is specified beforehand, preferably via a graphical user interface, so that the length compensation carriage 2 can be positioned. The desired tensile force on conductors 3 is then set at the pressure regulator valve 44 of travel compensation carriage 4. Typical values are in the order of about 50 N. Then, carriage 1 is moved back until carriage 4 of twisting head 5 is drawn into the pneumatically regulated travel range by the clamped conductors 3.

Then, the twisting operation is started at a slow rotating speed of twisting head 1 or twisting heads 1, 5, and continued until carriage 4 reaches the end of its travel path. At the same time the correlation of the travel path to the rotations is detected via displacement sensor 7 of carriage 4. In this way, the actual data is collected for the start of the travel profile parabola. From this data, the parabola can be calculated including the progressive travel profile. In this way, the travel profile for twisting head 1 and length compensation carriage 2 is programmable. The calculated travel profile is based on a relatively small set of actual data, so the deviations of all subsequent twisting operations must be corrected as necessary. The necessary corrections can be determined with the aid of travel sensor 7 of travel compensation carriage 4 and included for purposes of correcting the travel profile parabola.

A further advantageous application of the invention is the use of travel compensation carriage 4 to make automated comparative measurements of the actual lengths of the two more single conductors 3 that have been cut to length individually one after the other, to ensure that exactly the same length of the conductors 3 to be twisted is present in the twisting area.

After the first conductor has been cut to length by means of the conductor retraction mechanism and transferred to the grippers in the two twisting heads 1, 5, length compensation carriage 2 is moved away from the opposite clamping device until conductor 3 is taut, and then travel compensation carriage 4 is moved so that the preset tensile force thereof acts axially on single conductor 3. Length compensation carriage 2 is then moved farther, as far as a defined reference point of carriage 4, which is defined as the reference point using a value from travel sensors 7 or a fixed transducer. The travel point reached by length compensation carriage 2 at this point (determined from resolver data from its servomotor) is then stored.

Length compensation carriage 2 is then retracted to its starting position, wherein the tensile force acting axially on conductor 3 is also reduced to zero and travel compensation carriage 4 returns to its starting position, and the conductor that was measured can be removed or ejected from twisting heads 1, 5.

The same procedure is then carried out with the second conductor 3. By comparing the travel point positions of length compensation carriage 2 for the first and second and possibly other single conductors 3, the length difference between the two conductors can be calculated. This differential dimension can now be used to correct the operation of cutting conductor 3 to length.

The invention claimed is:

1. A twisting device for electrical conductors, comprising:

at least one twisting head (1) that is drivable by motor power to rotate about an axis of rotation relative to a base, a clamping device for ends of the conductor (3) farthest from the twisting head (1), wherein:

the twisting head (1) is movable in a direction of its axis of rotation toward the clamping device, the twisting head (1) is mounted on a first, automatically and motorised movable length compensation carriage (2), the clamping device is mounted on a travel compensation carriage (4) that is movable towards the length compensation carriage (2) in a direction essentially parallel to the axis of rotation of the twisting head (1), and to which a force acting essentially parallel to the axis of rotation is applied via a force-generating element.

2. The twisting device according to claim 1, comprising a further twisting head (5) which is rotatable in an opposite direction with regard to the first twisting head (1) about an axis of rotation shared with the first twisting head (1), wherein the further twisting head (5) is mounted as said clamping device on the travel compensation carriage (4).

3. The twisting device according to claim 1, wherein the travel compensation carriage (4) is passively displaceable and is subjected to a force directed away from the first twisting head (1) by means of a preload element as said force-generating element.

4. The twisting device according to claim 3, wherein a preload force of said preload element is adjustable at least before a start of activation of the drive unit of the length compensation carriage (2) and remains constant throughout the twisting process.

5. The twisting device according to claim 3, wherein said preload element is a pneumatic cylinder (6), connected to a pressure source (41, 42, 43) via a controlled pressure control valve (44).

6. The twisting device according to claim 5, wherein a piston rod of the fluid cylinders (6) and/or the travel compensation carriage (4), respectively, is equipped or coupled with a displacement sensor (7), which is connected to an evaluation unit for calculating and evaluating a travel profile of the travel compensation carriage (4).

7. The twisting device according to claim 1, wherein the travel compensation carriage (4) is equipped with a force measuring sensor and a motorised drive unit as said force-generating element, and the travel compensation carriage (4) is subjected to a force depending on signals of the force measuring sensor by the drive unit at least during the twisting process, said force directed away from the first twisting head (1) is variable.

8. The twisting device according to claim 7, wherein the drive unit or a control device of the drive unit for the travel compensation carriage (4) is connected to an evaluation unit for determining and evaluating a travel profile of the travel compensation carriage (4).

9. The twisting device according to claim 1, wherein a drive unit for the length compensation carriage (2) is activatable via a programmable controller to travel a travel profile prescribed for each conductor (3), conductor type and/or twist parameter, primarily towards the clamping device, and wherein a maximum possible displacement path of the travel compensation carriage (4) is kept shorter than a maximum possible displacement path (8) of the length compensation carriage (2) by adjustable limit stops (8*a*, 8*b*).

10. The twisting device according to claim 9, wherein at least the drive unit of the length compensation carriage (2) is connected to a control unit, in which a respective travel profile is stored for each combination of conductors (3) and twist parameters for actuating the drive unit of the length compensation carriage (2).

11. The twisting device according to claim 10, wherein a routine is implemented in the control unit which queries the evaluation unit and/or the displacement sensor (7) and depending on the calculated travel profile of the travel compensation carriage (4) generates a quality assessment and/or adapts the travel profile of the length compensation carriage (2), and stores it in the control unit as the new travel profile for this combination of conductors (3) and twist parameters, and/or cancels the twisting process with an error message.

12. The twisting device according to claim 10, wherein a routine is implemented in the control unit which controls the length compensation carriage (2) in such manner that the values delivered by the force measuring sensor lie within a prescribed range, and depending on the calculated travel profile of the travel compensation carriage (4) generates a quality assessment and/or adapts the travel profile of the length compensation carriage (2), and stores it in the control unit as the new travel profile for this combination of conductors (3) and twist parameters, and/or cancels the twisting process with an error message.

* * * * *